United States Patent [19]

Singer

[11] Patent Number: 4,470,589

[45] Date of Patent: Sep. 11, 1984

[54] METHOD AND APPARATUS FOR FEEDING AND LAMINATING SHEETS

[76] Inventor: Karl Singer, 2282 Thorntree La., Palatine, Ill. 60067

[21] Appl. No.: 429,616

[22] Filed: Sep. 30, 1982

[51] Int. Cl.[3] ..... B65H 3/02; B29C 19/02

[52] U.S. Cl. ..... 271/11; 156/324; 156/364; 156/496; 156/552; 271/98; 271/107

[58] Field of Search ..... 156/324, 496, 552, 556; 271/93, 98, 95, 107, 19, 20, 110, 111, 14, 94, 106; 226/88

[56] References Cited

U.S. PATENT DOCUMENTS

| | | | |
|---|---|---|---|
| 1,153,434 | 9/1915 | Kruse | 271/102 |
| 2,461,376 | 2/1949 | Feldmeier | 226/88 X |
| 2,714,006 | 7/1955 | Layden | 271/95 |
| 3,466,028 | 9/1969 | Bays | 271/106 X |
| 4,069,081 | 1/1978 | Drower et al. | 156/324 X |
| 4,171,130 | 10/1979 | Jeschke | 271/111 X |

*Primary Examiner*—David Simmons

*Attorney, Agent, or Firm*—Robert E. Wagner; Ralph R. Rath

[57] ABSTRACT

A laminating machine consists of a feeding mechanism for continuously supplying sheets along a path towards a laminating roll which also receives a continuous supply of laminating film. The laminating film is fed from a continuous supply and a dewrinkling mechanism is disposed along the path to remove any wrinkles prior to being received into the laminating rolls. The laminating machine also incorporates a decurling mechanism downstream of the laminating rolls for removing any tendency of the laminated material to curl between opposite ends. The sheet feeding mechanism also incorporates novel means for delivering the sheets and accurately controlling the flow of the sheets during the laminating process.

3 Claims, 12 Drawing Figures

40
60
66
68
82
84
80
58
94
92
88
56
54
72
74
70
52
64
62
76
96
42
5
P
50
112
114
118
100
116
102
3.
4.
5.

METHOD AND APPARATUS FOR FEEDING AND LAMINATING SHEETS

DESCRIPTION

1. Technical Field

The present invention relates generally to laminating machines and, more particularly, to the laminating machine having a novel sheet feeding mechanism and certain features that improve the quality of the laminated product.

2. Background Prior Art

The use of laminating machines for covering paper with a film barrier has been known for many years. It has become customary to laminate various types of sheet products, such as product specification sheets, menus and the like. The laminating process usually consists of feeding individual sheets through a pair of laminating rolls which receive a continuous supply of laminating film that is joined with the sheet at the laminating stations.

One of the problems encountered in this process is the accurate control of the feeding of the sheets so that they are properly joined with the laminating film and the laminating film is free of any wrinkles. Since the laminating process requires heat to join the film to the sheets, the sheets are somewhat distorted during the laminating process causing the sheets to curl in most instances.

SUMMARY OF THE INVENTION

The laminating machine according to the present invention includes a sheet feeding mechanism for continuously feeding individual sheets towards a laminating station which also receive a continuous supply of laminating film that are joined at the station. The film feeding mechanism incorporates a dewrinkling means which automatically removes any wrinkles from the continuous supply of film before it is delivered to the laminating station.

The sheet feeding mechanism of the present invention includes a stacking bin for receiving a stack of sheets, a stop position adjacent the leading edge of the stack of sheets, a gripping member reciprocable along a path for the sheets and having gripping means for gripping an exposed sheet adjacent the trailing edge. The gripping member incorporates drive means for initially moving the gripped sheet in one direction away from the stop and then in the opposite direction for moving the sheet along the path. The sheet feeding mechanism also incorporates separating means for separating the trailing edge of the stack of sheets and also for producing a cushion of air for suspending the exposed sheet that is being manipulated by the gripping means. The sheet feeding machine also incorporates automatic sensor means that activates the system as a function of sheet length.

The laminating machine also includes a simplified dewrinkling mechanism consisting of a pair of freely-rotatable wheels that cooperate with an idler roller to move the film axially of the idler roller before it is delivered to the laminating rollers. The laminating machine also incorporates a novel decurling mechanism that automatically tensions the sheet immediately after the laminating process to prevent possibility of the sheet from curling after the laminate has been cut.

BRIEF DESCRIPTION OF SEVERAL VIEWS OF DRAWINGS

FIG. 1 of the drawings shows a laminating machine incorporating various features of the present invention;

DETAILED DESCRIPTION

Figure 1:
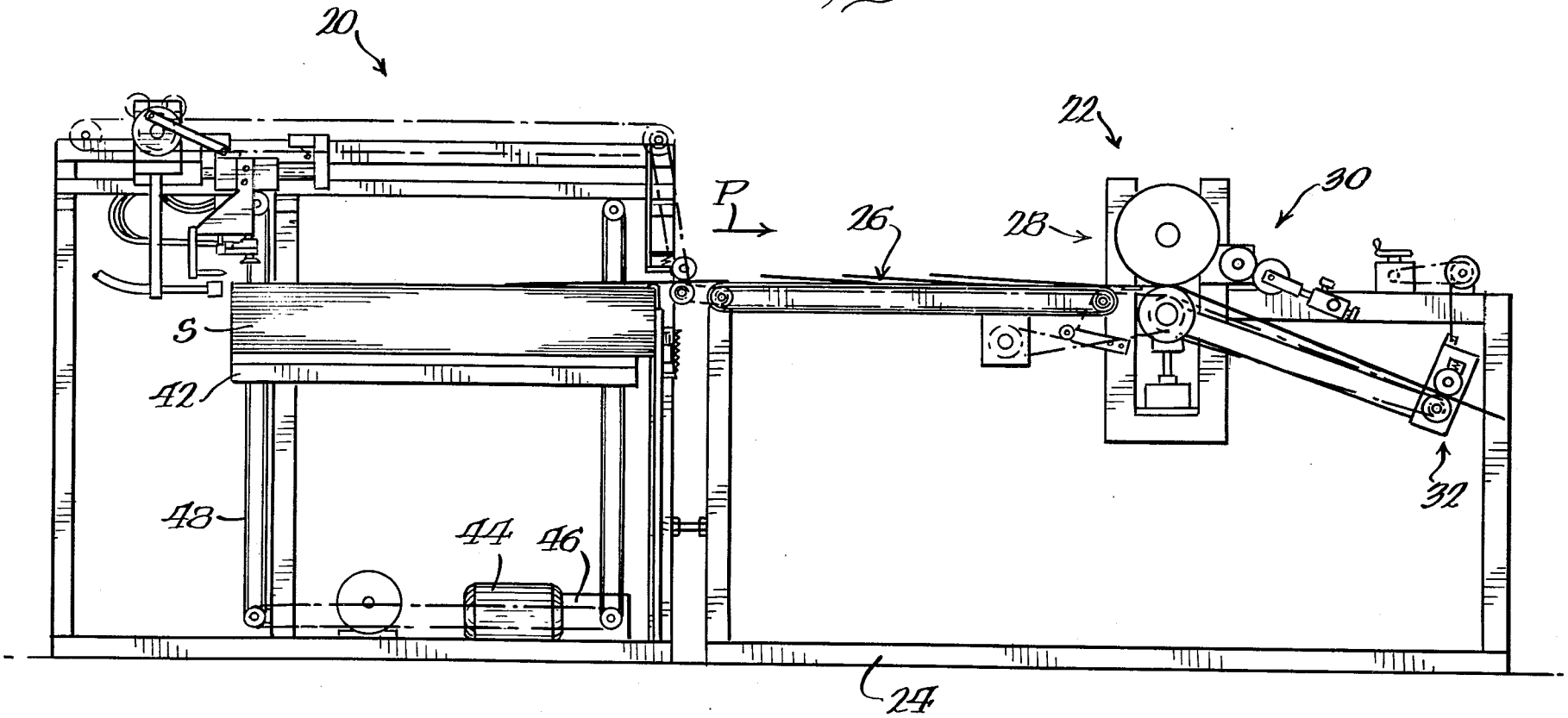

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

The apparatus of the present invention is illustrated generally in FIG. 1 and includes a sheet feeding mechanism, generally designated by reference numeral 20, and a laminating machine, generally designated by reference numeral 22. The laminating machine includes a frame, generally designated by reference numeral 24, a transfer conveyor 26 for transferring sheets from sheet feeding mechanism 20 to a laminating station 28 where a laminate film is laminated to the sheet and delivered to a cutting mechanism (not shown).

The laminating machine 22 also incorporates a unique dewrinkling mechanism or means 30 and a simplified decurling mechanism 32.

Sheet Feeding Mechanism

The sheet feeding mechanism of the present invention is illustrated in detail in FIGS. 2–9 and includes a frame 40 supporting a vertically-movable platform or bin 42 which receives a stack of sheets S. The platform or bin 42 is moved vertically on frame 40 through a drive motor 44, a gear reducing unit 46 and a plurality of endless chains 48 connected to platform 42.

Figures 2, 4:
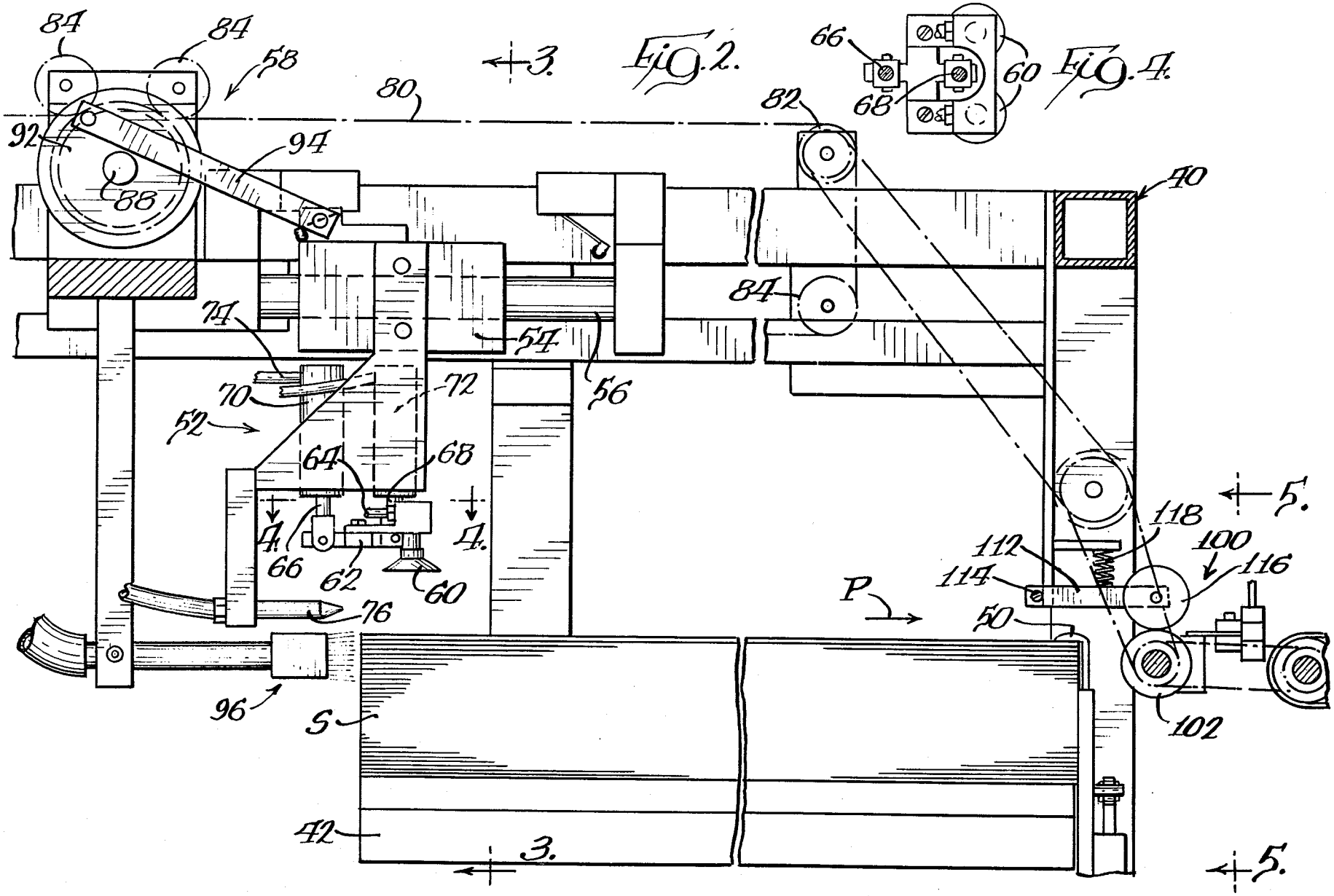
FIG. 2 is an enlarged fragmentary side view of the feeding mechanism of the present invention.
FIG. 4 (appearing with FIG. 2) is a cross-sectional view as viewed along line 4—4 of FIG. 2.

A stop 50 is located above the stack of sheets S adjacent the leading edge thereof, as viewed in the direction of the path of flow of sheets, generally designated by reference numeral P in FIGS. 1 and 2.

The top or exposed sheet of the stack of sheets is gripped by a gripping member 52 and initially moved towards the left, as viewed in FIG. 2, and then moved to the right along path P. The gripping member or means 52 consists of a block 54 reciprocated along a bar 56 by a drive means, generally designated by reference numeral 58.

The gripper means 52 includes a pair of suction cups 60 (FIGS. 2 and 3) carried by a bar 62 and each connected to a vacuum source 64. The bar 62 is suspended on the outer ends of first and second piston rods 66 and 68 extending from fluid cylinders 70 and 72. The piston rods 66 and 68 are preferably biased to the retracted position illustrated in FIG. 2 by springs (not shown) and are extended by pressurized fluid delivered through lines 74. A fluid pressure nozzle 76 also forms part of the gripper means and aids in separating the top sheet from the stack, as will be explained later.

Figure 3:
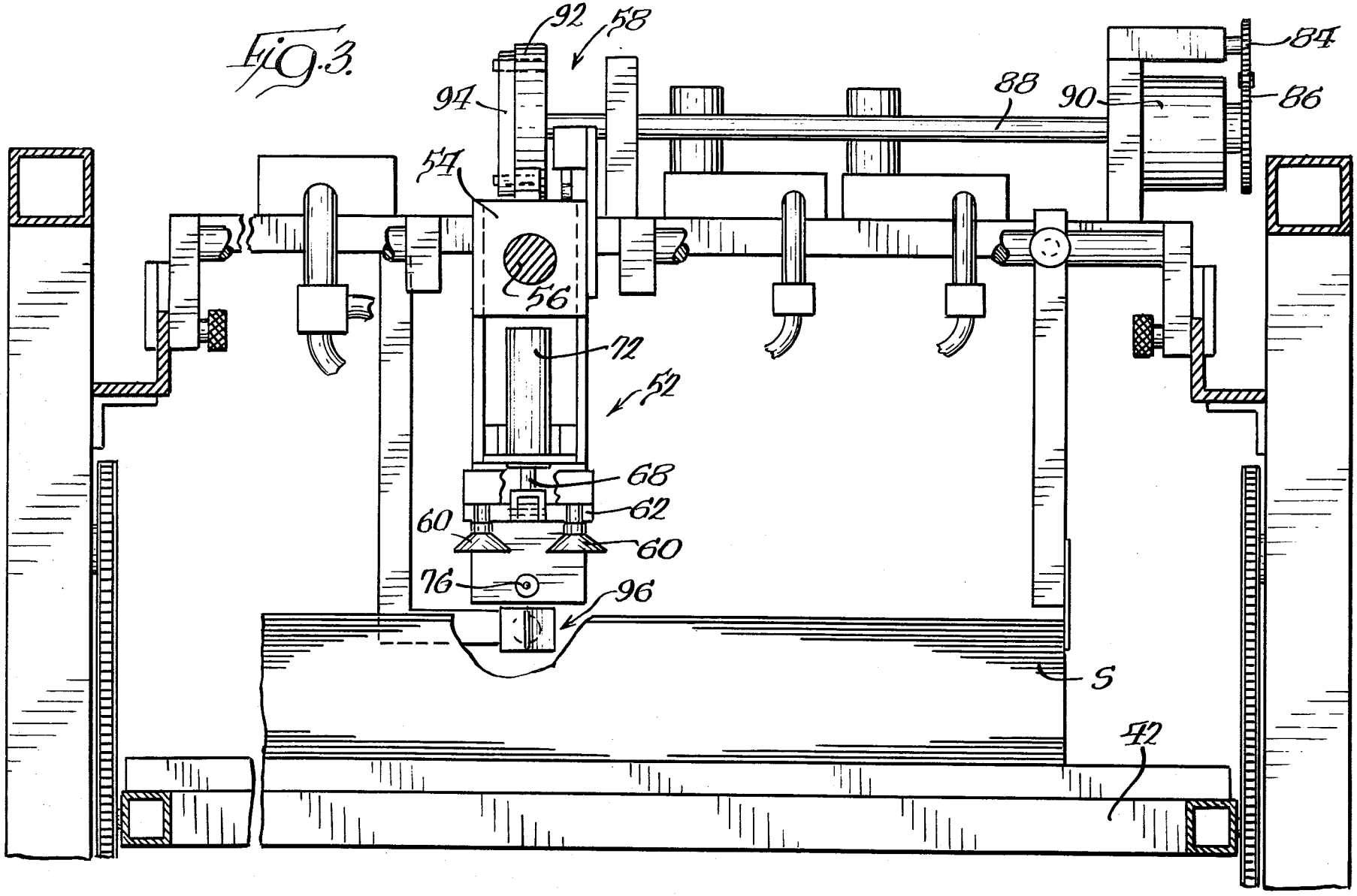
FIG. 3 is a cross-sectional view as viewed along line 3—3 of FIG. 2.

The drive means 58 for reciprocating the gripping member 52 is illustrated in FIGS. 2 and 3 and includes an endless drive chain 80 entrained over a drive sprocket 82 and a plurality of idler sprockets 84, all supported on frame 40, as well as a driven sprocket 86 (FIG. 3). Driven sprocket 86 is connected to drive shaft 88 through a clutch 90 and the opposite end of the drive shaft 88 has a driven member 92 supported thereon. Driven member 92 is connected by a link 94 to reciprocating block 54.

The sheet feeding mechanism also includes a sheet separating mechanism 96 supported on frame 40 which directs a flow of pressurized air to the trailing edge of the stack of sheets S to initially separate the sheets, for a purpose that will be described later.

The sheet feeding mechanism also incorporates a novel method of activating the drive means 58 as a direct function of the length of the sheet to be fed. The activating mechanism cooperates with feed mechanism 100, illustrated in FIGS. 2 and 5. The feed mechanism 100 consists of a drive roller 102 that is driven by an endless chain 104 entrained over a sprocket 105 on an idler shaft 106. The feed mechanism also includes an idler shaft 110 that is rotatably supported on a pair of arms 112 pivoted on a shaft 114 (FIG. 2). Shaft 110 carries a pair of pressure rollers 116 and is biased towards drive roller 102 through biasing springs 118. Thus, the sheets to be fed are received between drive or feed roller 102 and pressure rollers 116, which in turn moves them to the transfer belt 26 (FIG. 1), as will be explained later.

Figure 5:
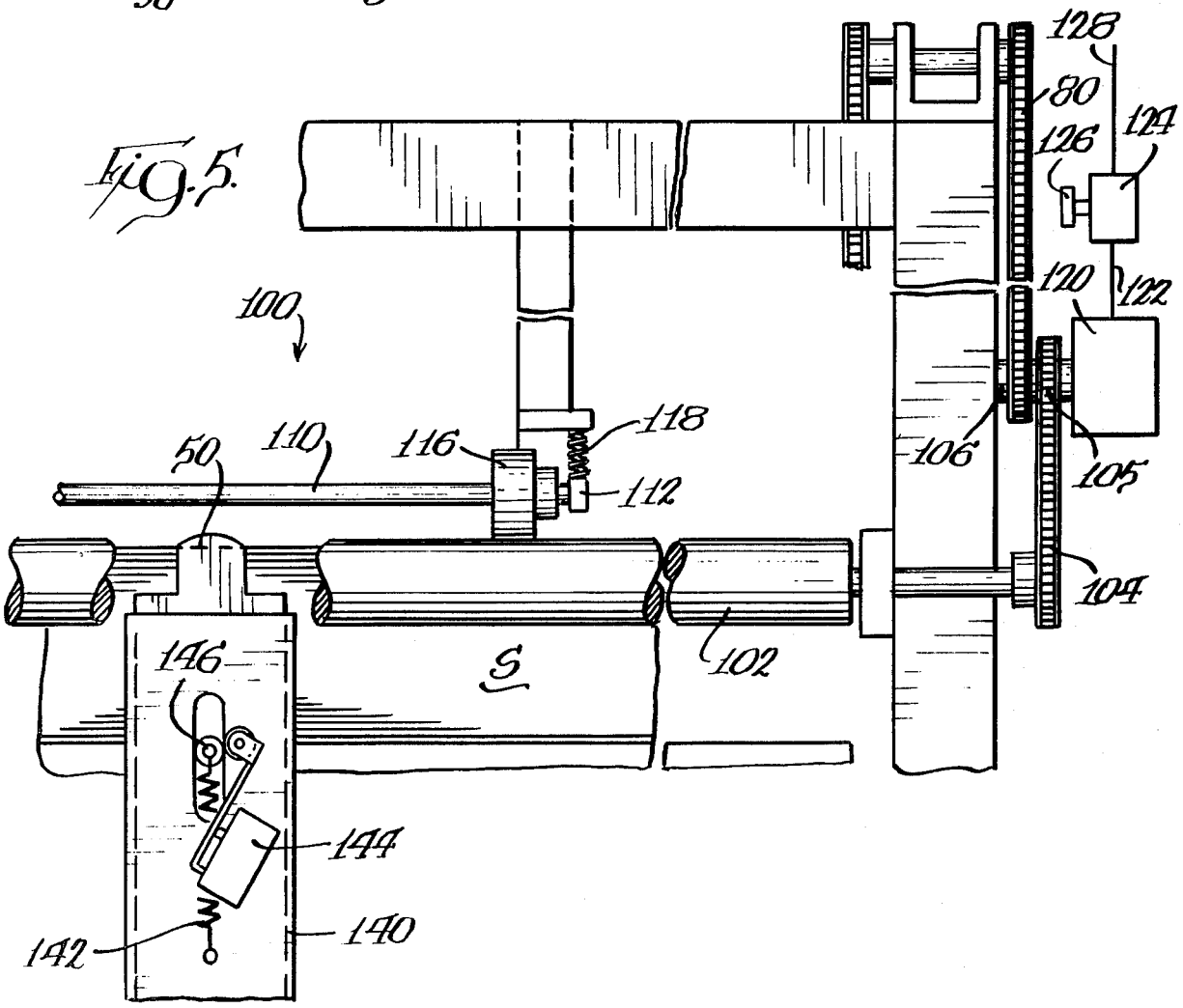
FIG. 5 is an enlarged fragmentary sectional view as viewed along line 5—5 of FIG. 2.

The unique counting and activating mechanism for the sheet feeder is illustrated schematically in FIG. 5 and includes a pulse generator 120 that is connected to shaft 106 and produces output pulses as a function of the degree of rotation of feed shaft 102, which in turn is indicative of the incremental length of the sheet. For example, each output pulse from pulse generator or encoder 120 represents 1/50th of an inch of length of sheet. The output pulses of the pulse generator 102 are fed through a line 122 to a control panel 124. Control panel 124 incorporates a presetable counter (not shown) which is manually adjustable by a control knob 126 to represent the length of a sheet that is being fed. When the counter receives the preset number of pulses through line 122, a signal is generated to output line 128, which in turn activates the clutch 90 (FIG. 3) to start a sheet feeding cycle.

Figure 9:
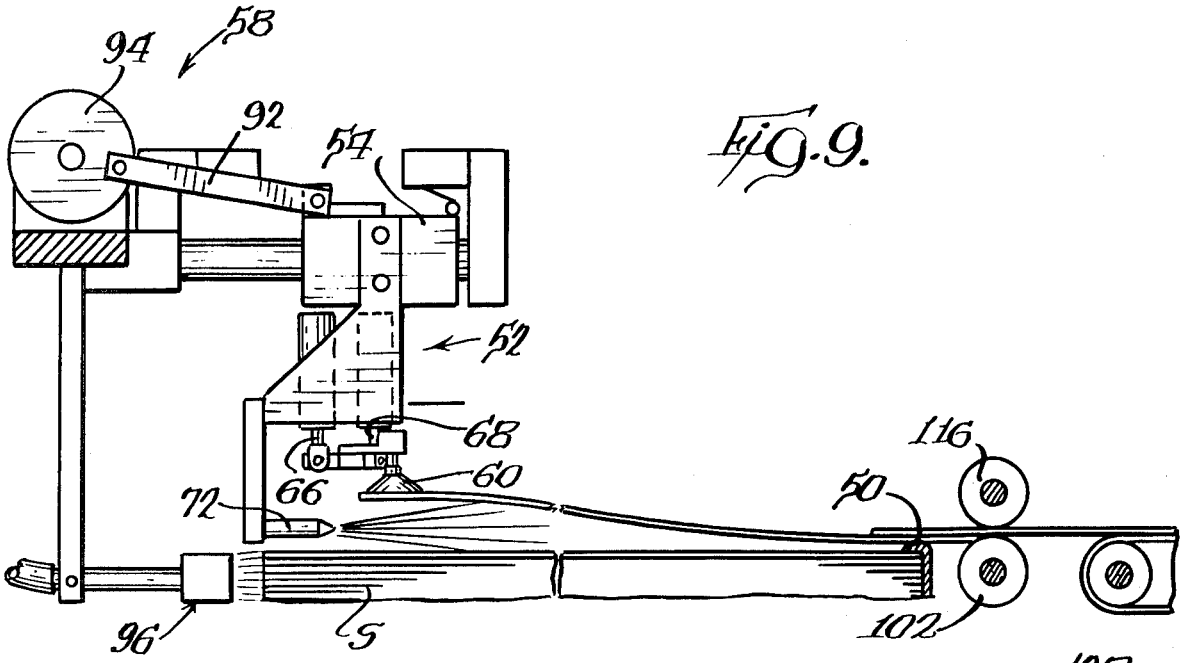
FIGS. 6–9 are schematic views of the steps occuring during the feed of a sheet with the feeding mechanism of the present invention.
Figure 6:
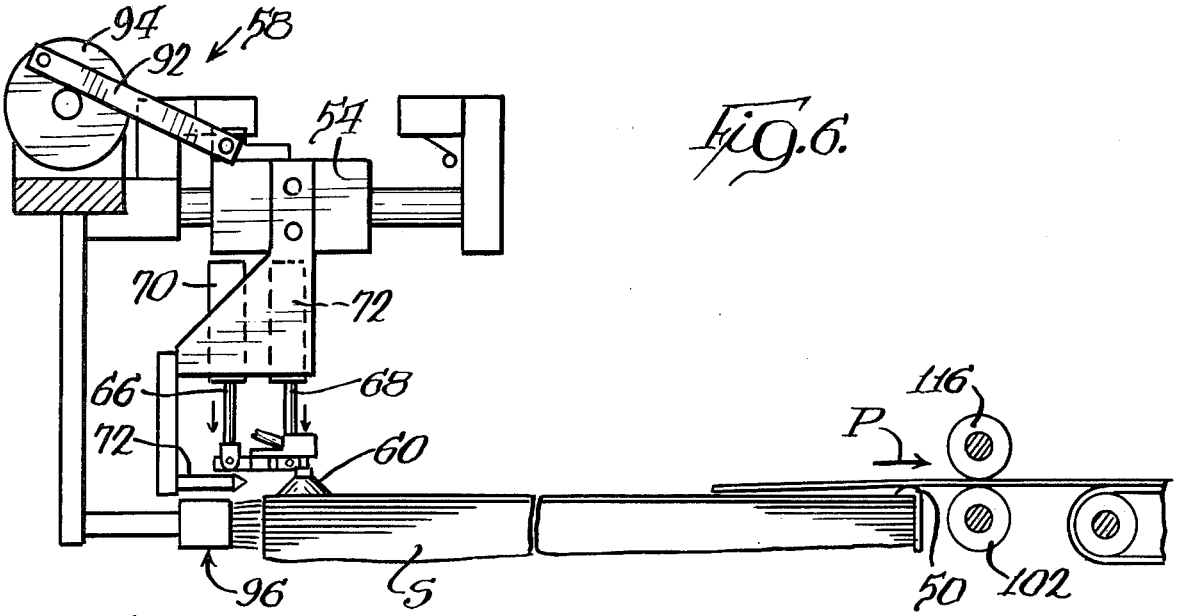
Figure 7:
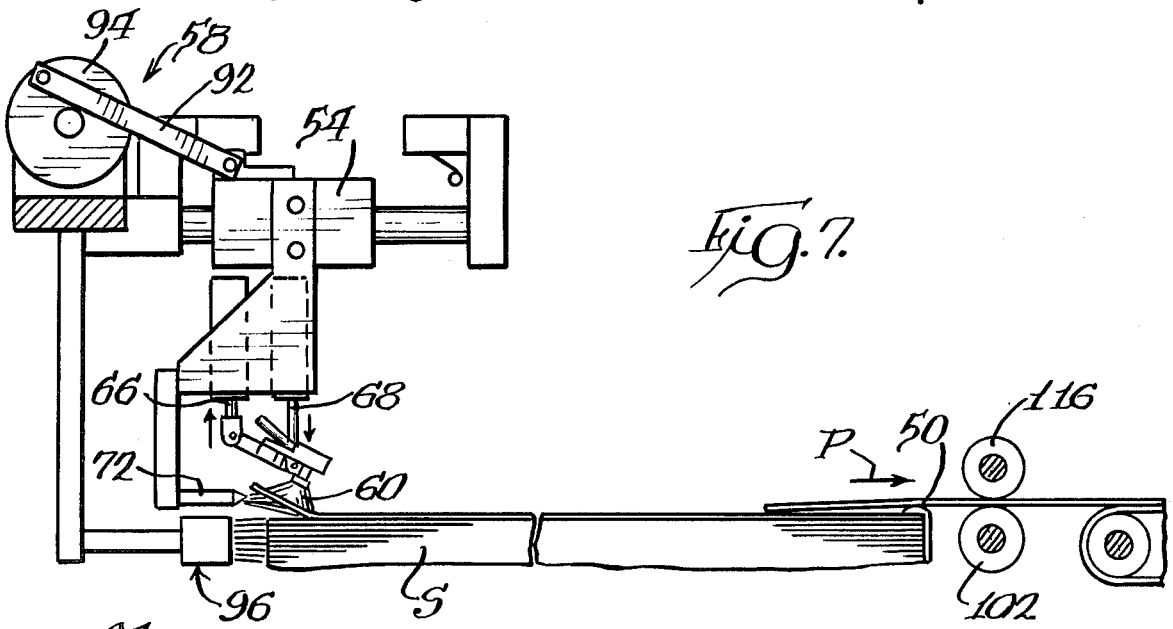
Figure 8:
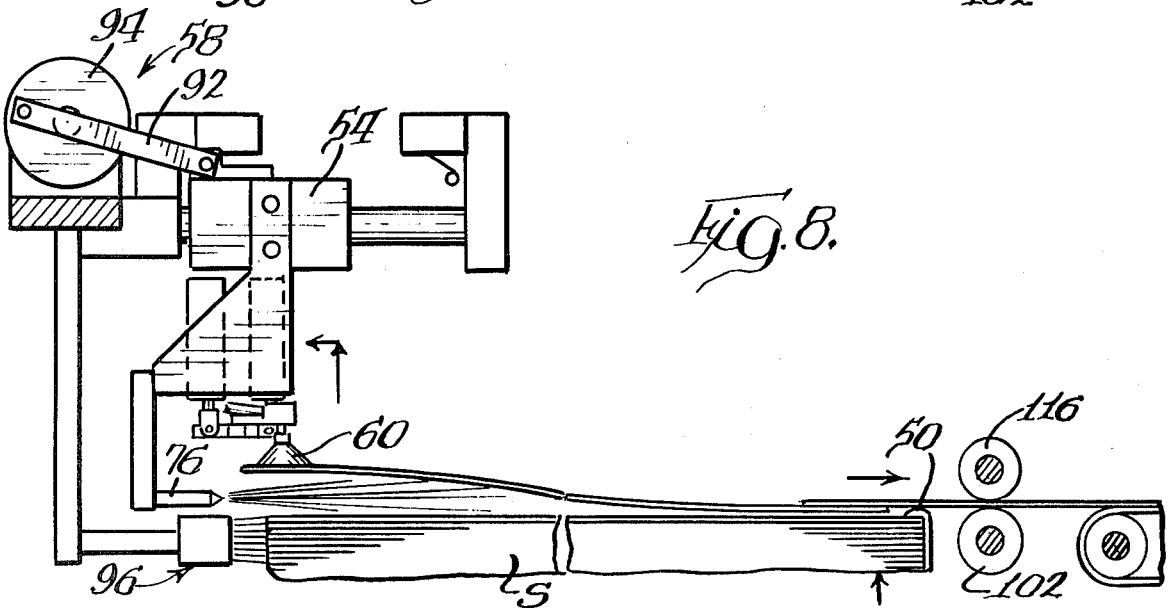

The sequence of operation of the sheet feeding mechanism is best understood with particular reference to FIGS. 6–9. A continuous supply of pressurized air is fed through separating means 96 to initially cause a partial separation of the trailing edges of the sheets in stack S, while the exposed sheet engages stop 50, as illustrated in FIG. 6. To initiate the cycle, both piston rods 66 and 68 are extended by applying pressurized fluid to the head ends of cylinders 70 and 72 to move the suction or vacuum means 60 and 62 to the position illustrated in FIG. 6. After the suction cups have gripped the exposed sheet or top sheet adjacent the trailing edge, piston rod 66 is retracted to the position illustrated in FIG. 7 to move the trailing edge of the exposed sheet from the position illustrated in FIG. 6 to that illustrated in FIG. 7, wherein the trailing edge is at an angular relation to the remaining sheets in the stack. Pressurized air is then delivered through nozzle 76 to aid in the separation of the top sheet from the remainder of the stack. As the pressurized air is being supplied through nozzle 76, the second piston rod 68 is retracted to move the suction cups 60 to the position illustrated in FIG. 8. Pressurized air is continuously supplied through nozzle 76 to aid in the separation of the top sheet from the stack and also provide a cushion of air for the sheet as it is being removed and fed along the path. The drive mechanism 58 is initially in the position illustrated in FIG. 7 wherein the eccentric connection between the arm 94 and drive member 92 is above the center of the shaft 88. Thus, when the clutch 90 is activated, the arm 92 will initially move the block 54 to the left, as viewed in FIGS. 7 and 8 and move the sheet from the position illustrated in FIG. 7 to the position illustrated in FIG. 8 where the leading edge is moved from under the stop 50. Continued rotation of drive member 94 will subsequently move the block to the right, as viewed in FIG. 8, from the position illustrated in FIG. 8 to the position illustrated in FIG. 9. In the position illustrated in FIG. 9, the block 54 and the remainder of the gripper member 52 are in the right-hand-most position during the cycle of operation. In this position, the leading edge of the top or gripped sheet is received between feed roller 102 and pressure rollers 116. It should be noted that the respective sequential sheets are fed between the feed roller and pressure rollers in an underlapped relation, as illustrated in FIG. 9, for a purpose that will be described later.

The gripper means 52 is then moved to its initial starting or "home" position, illustrated in FIG. 6 and the cycle is repeated. According to one aspect of the invention, the mechanism incorporates automatic means for controlling the movement of the table or platform 42 as the sheets are being removed from the top of the stack. During normal operation of the sheet feeding mechanism, the stack of sheets S will retain the stop in the position illustrated in FIG. 5 wherein a switch 144 is held in an operative position by a pin 146 carried by stop 50. As the sheets are being removed, switch 144 will activate and deactivate to control the motor 44, which in turn controls raising of the platform. The feeding mechanism also incorporates means for automatically shutting down the unit in the event that the stack is below a preselected level, which will not be described in detail since such features are conventional in the art.

Laminating Unit

Figure 10:
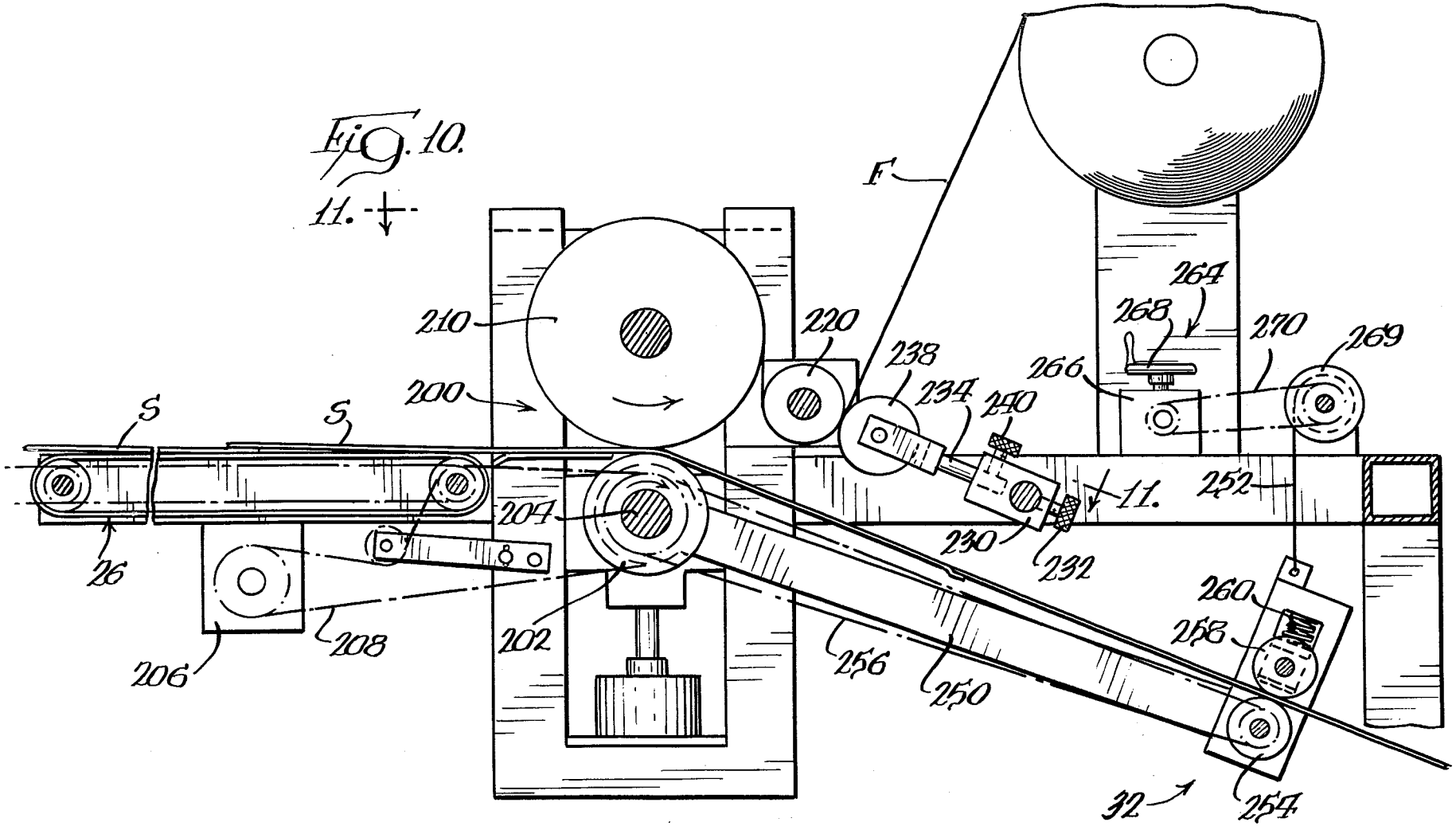
FIG. 10 is an enlarged fragmentary cross-sectional view of the laminating portion of the machine.

The laminating unit of the laminating machine is best illustrated in FIG. 10 wherein sheets S are fed in overlapping relation by transfer belt 26 into a laminating means, generally designated by reference numeral 200. The laminating means 200 consists of a driven roller 202 supported on a shaft 204 and driven by a motor 206 through a drive chain 208, which also drives transfer belt 26. A laminating roll 210 cooperates with driven roller 208 to laminate a continuous supply of laminate film F onto the respective sheets. As indicated, above the sheets are initially delivered to the transfer belt 26 in overlapping relation and this overlapping relation is controlled by properly controlling the respective speeds of the driven roll 202 and the transfer belt 26.

Stated another way, the laminating rolls 202 and 210 are driven at a speed which is just slightly greater than the speed of the transfer belt 26 to reduce the overlap to a minimum overlap, as illustrated in the right-hand portion of FIG. 10. The overlap arrangement between the respective sheets is necessary to prevent direct contact between the heated laminating roll 210 and the driven roll 202.

Dewrinkling Mechanism

Figure 11:
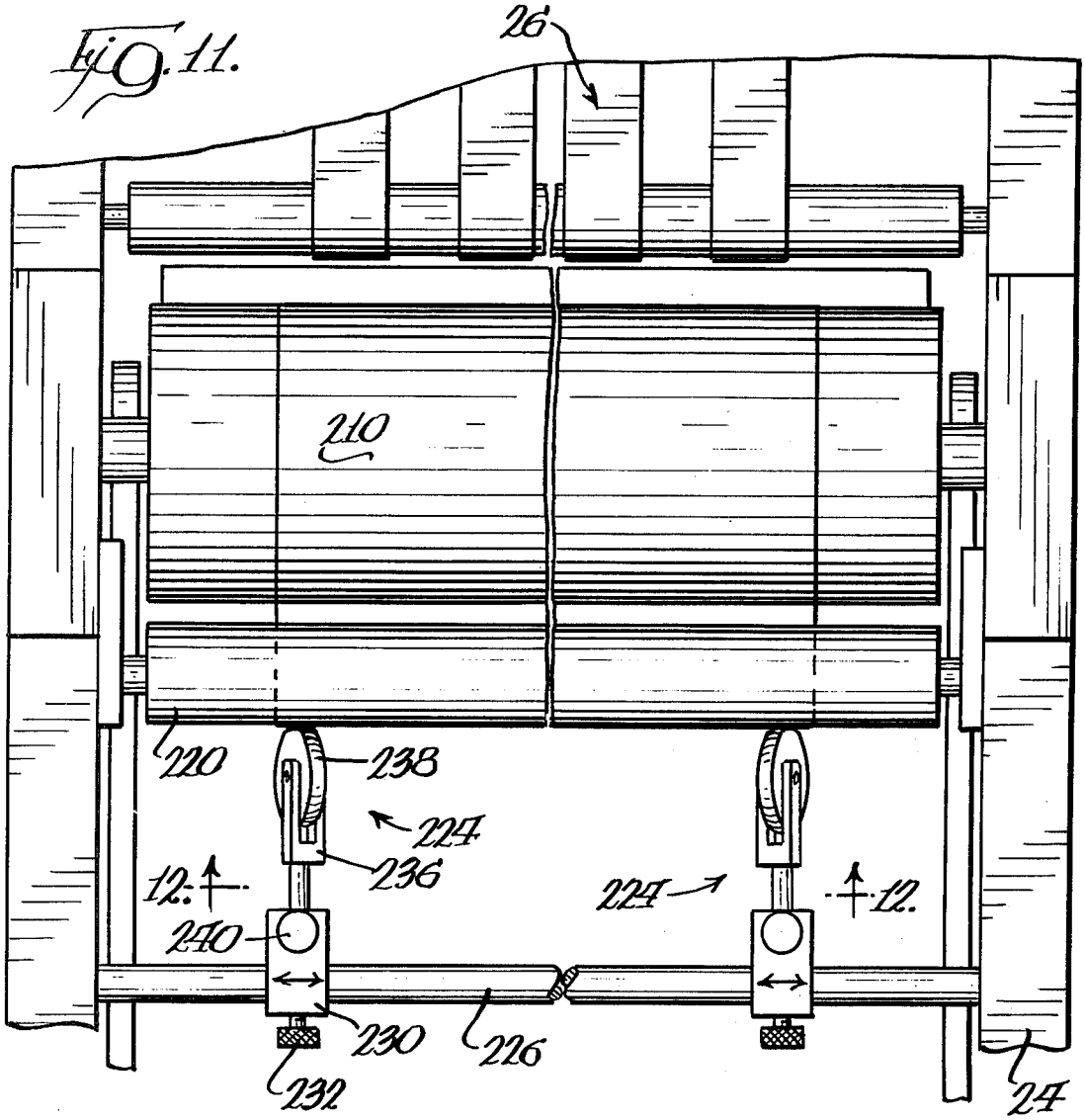
FIG. 11 is a cross-sectional view as viewed along line 11—11 of FIG. 10; and, FIG. 12 is a cross-sectional view as viewed along line 12—12 of FIG. 11.

According to one aspect of the present invention, the laminating unit incorporates a unique dewrinkling mechanism which removes any wrinkles which may be present in the continuous supply of laminate film F. The dewrinkling means 30 is most clearly illustrated in FIGS. 11 and 12. The continuous supply of film F is entrained around an idler roller 220 and then over laminating roll 210. The idler roll 220 is rotatable about a fixed axis on frame 24 and has a pair of dewrinkler wheel mechanisms 222 cooperating with the idler roll 222 to stretch the film F axially of the idler roll 220. Each idler wheel mechanism is identical in construction and is adjustably supported on a fixed shaft 226.

Figure 12:
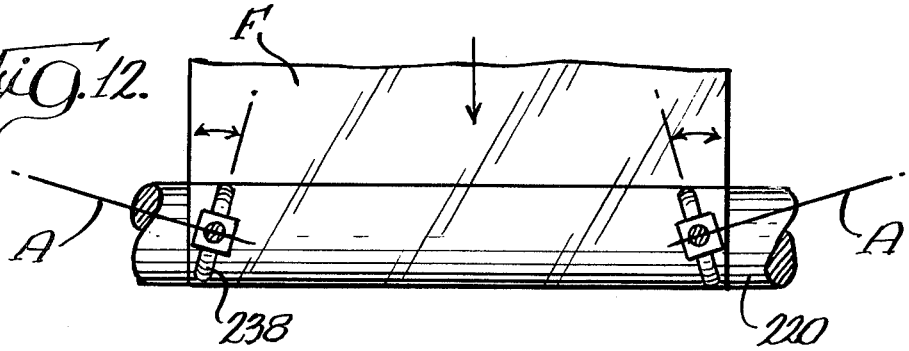

Each dewrinkler wheel mechanism 224 consists of a block 230 that is adjustably supported on fixed shaft 226 and held in such adjusted position by an adjustment screw 232. The support block 230 has an opening therein (not shown) for receiving a stud 234 of a support bracket 236 upon which a dewrinkler wheel 238 is freely rotatable. As illustrated in FIG. 12, the dewrinkler wheels 238 are rotatable about axes A which are angularly related to the fixed axis of idler roll 220. This angular relation between the axes A of the dewrinkler rolls 238 and the roll 220 will cause a stretching or ironing action of the laminate film axially of the idler roll 220. According to a further aspect of the invention, the angular orientation between the axes A and the fixed axis of roll 220 is adjustable by rotating the stud 234 within the opening in block 230 and maintaining the adjusted position through the use of a set screw 240. As can be appreciated from this description, the dewrinkling mechanism is simple in construction, easy to assemble and can readily be adjusted for varying conditions of wrinkle in the laminate film.

Decurling Mechanism

The decurling mechanism 32 is most clearly illustrated in FIG. 10 is includes a frame member 250 pivoted about drive roller 202 or shaft 204 and suspended by a cable mechanism 252. A driven roller 254 is driven through a chain 256 from shaft 204, while an idler roller 258 is biased towards driven roller 254 through springs 260.

The angular orientation between frame 250 and transfer belt 26 is adjustable through an adjusting device 264 which includes a gear box 266 driven by a hand wheel 268. Gear box 266 is connected to a cable reel 269 by a drive chain 270. By rotation in the proper direction of hand wheel 268, the outer end of frame 250 can be raised and lowered with respect to shaft 204, thus changing the angular orientation of the frame 250 with respect to the initial path of sheets S.

As will be appreciated, during the normal lamination process, wherein the sheets S extend around driven roller 202 and move off in an angular direction, there is a tendency to stretch the top surface of the sheet during the laminating process which will then have a tendency to curl to a non-flattened state after the lamination has been separated between opposite ends of the sheet. The decurling device 232 reduces this tendency by driving the driven roller 254 at a speed which is slightly greater than the speed of roller 202 which will thereby tension the sheet at the point of contact with driven roller 202 to reduce the difference in compression in the fiber structure between the top and bottom surfaces of the sheet. Again, as can be appreciated, the decurling mechanism is simple in construction and easy to operate, with all of the driven elements being driven by the common drive motor 206 for the entire laminating machine.

I claim:

1. A sheet feeding mechanism comprising a stacking bin for receiving a stack of sheets, a stop adjacent said bin positioned to engage a leading edge of said sheets, means for moving said sheets towards said stop, a gripping member reciprocable along a path for said sheets and having vacuum gripping means for gripping an exposed sheet adjacent a trailing edge, guide means extending generally parallel to said path and supporting said gripping means, moving means for moving said gripping means toward and away from said stack of sheets, said moving means including first and second spaced cylinder and piston rod assemblies with said first piston rod being retracted into said first cylinder to tilt said trailing edge of said exposed sheet and said second piston rod being subsequently retracted into said second cylinder to move said trailing edge away from said stack of sheets, and drive means for reciprocating said gripping member along said guide means to initially move a gripped sheet in one direction away from said stop and in the opposite direction along said path.

2. A sheet feeding mechanism as defined in claim 1, in which said drive means includes a rotatable member rotated about a fixed axis and a link connected at one end to said gripping member and at an opposite end to said rotatable member at a point spaced from said fixed axis.

3. A sheet feeding means as defined in claim 1, in which said sheets are fed to a laminating machine including a drive roller and a cooperating laminator roller, further including decurling means cooperating with said drive roller and said laminating roller comprising a frame pivoted on said drive roller and a pair of rollers on an outer end of said frame, at least one of which is driven, and adjustable means for varying the angular orientation of said frame with respect to said path.

* * * * *